United States Patent [19]

Borenstein

[11] 4,265,849

[45] May 5, 1981

[54] METHOD FOR PRODUCING MULTIFILAMENT THERMOPLASTIC YARN HAVING LATENT CRIMP

[75] Inventor: David E. Borenstein, Greenville, S.C.

[73] Assignee: Phillips Petroleum Company, Bartlesville, Okla.

[21] Appl. No.: 43,072

[22] Filed: May 29, 1979

[51] Int. Cl.[3] ..... D01D 5/22

[52] U.S. Cl. ..... 264/168; 28/214; 156/72; 156/435; 264/103; 264/177 F; 264/210.8; 264/290.5

[58] Field of Search ..... 264/168, 103, 177 F, 264/210.8, 290.5; 28/214; 156/72, 435

[56] References Cited

U.S. PATENT DOCUMENTS

| | | | |
|---|---|---|---|
| 3,152,380 | 10/1964 | Martin | 264/168 |
| 3,323,190 | 6/1967 | Boldniem | 28/72 |
| 3,374,302 | 3/1968 | Stanley | 264/290.7 |
| 3,457,338 | 7/1969 | Leferve | 264/168 |
| 3,488,940 | 1/1970 | Mehta | 57/157 |
| 3,498,044 | 3/1970 | Hopkins | 57/157 |
| 3,505,444 | 4/1976 | Stanley | 264/290.7 |
| 3,621,088 | 11/1971 | Hatcher et al. | 264/178 F |
| 3,715,422 | 2/1973 | Chopra | 264/168 |
| 3,803,675 | 4/1974 | Waterhouse | 264/210.5 |
| 3,995,420 | 12/1976 | Ohse et al. | 57/140 R |

FOREIGN PATENT DOCUMENTS

| | | | |
|---|---|---|---|
| 46-13174 | 4/1971 | Japan | 264/168 |
| 46-37784 | 11/1971 | Japan | 264/168 |
| 50-39721 | 12/1975 | Japan | 264/210.8 |

*Primary Examiner*—Jay H. Woo

[57] ABSTRACT

A multifilament thermoplastic yarn and process for the formation thereof which, when tufted or woven into a fabric, presents a grass-like appearance. The yarn is made by melt spinning and water quenching a melt-spinnable synthetic organic thermoplastic polymer, such as polypropylene, drawing the filaments, surface heating at least a portion of the thus drawn filaments, cooling the thus surface heated filaments and reheating the thus cooled filaments either before or after tufting, weaving or otherwise processing into a fabric to develop latent crimp in the yarn. Also disclosed is a carpet fabric employing the yarn and exhibiting grass-like appearance with exceptional cover and relatively soft hand.

27 Claims, 3 Drawing Figures

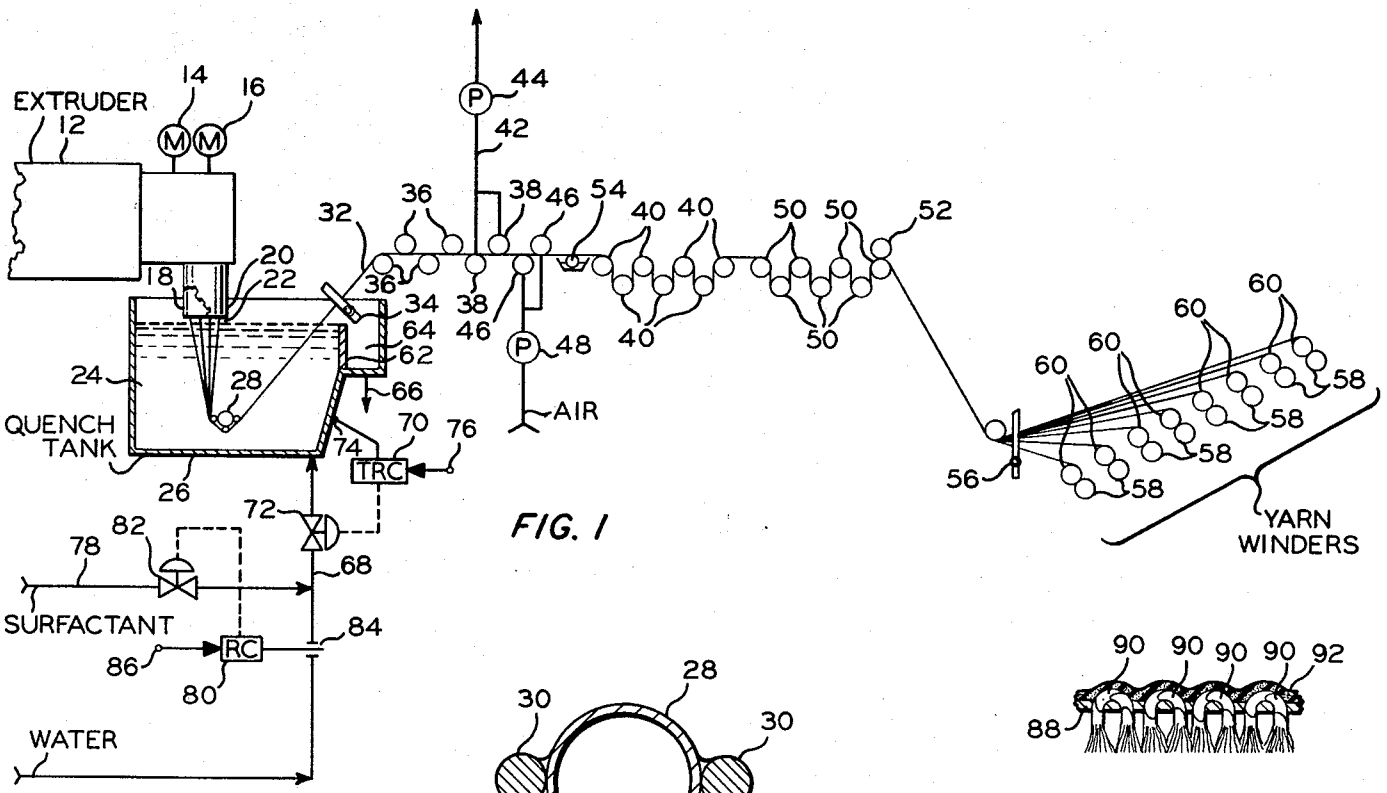
FIG. 1
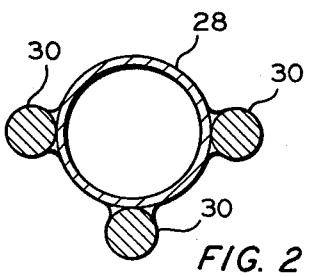
FIG. 2
FIG. 3

METHOD FOR PRODUCING MULTIFILAMENT THERMOPLASTIC YARN HAVING LATENT CRIMP

The present invention relates generally to the production of multifilament thermoplastic yarn. In one aspect the invention relates to a process for the production of grass-like thermoplastic yarn. In another aspect the invention relates to apparatus for the production of grass-like thermoplastic yarn. In still another aspect the invention relates to a method of forming a textile product comprising a grass-like thermoplastic yarn.

In the preparation of fibers from fusible polymers, it is customary to force the molten polymer through the orifices of a spinneret into a region where the temperature is lower than the temperature of the molten polymer. In the cooler region, the molten polymer sets up into filaments sufficiently firm to be taken away continuously by a suitable yarn forwarding device. Conventionally, the molten polymer is spun through a spinneret having orifices spaced from each other by relatively large distances in order to keep newly formed filaments separated until they have congealed sufficiently to prevent their sticking together or coalescing. Productivity of yarn per spinneret under these conditions is low, even at the highest practicable speeds of windup. Increased spinneret size can be achieved only to a limited extent due to the high pressures in the melt extrusion.

A second disadvantage of prior melt-spinning practices concerns the difficulty of coupling the steps in yarn preparation. After a filament is spun, drawing is generally necessary in order to raise the mechanical properties of the filaments to an acceptable level. However, filament input to the drawing step usually proceeds at a rate necessarily different from the rate of filament output from the spinning step. For example, it may be necessary to draw the filament at a much lower rate than is desirable for spinning the filament. Under such conditions, it is most efficient to interrupt the process of the yarn preparation, that is, to package the yarn temporarily after the spinning step for subsequent use in the drawing step. Even when it is possible to draw the yarn at a sufficiently rapid rate to allow its being used directly from the spinning step, the rate of yarn travel at the output from the drawing step often exceeds the capacity of currently available yarn-handling equipment.

Many of the prior art techniques for the production of yarn which, when tufted into a fabric, presents a grass-like appearance, have produced yarns which have an undesirable shiny or waxy appearance and which produce less than adequate cover especially when used to produce grass-like tufted outdoor carpet.

An object of the present invention is to provide a novel yarn of grass-like appearance.

Another object of the invention is to provide a new method for producing multifilament yarn.

One other object of the invention is to provide an economical method of producing an improved textile product.

Still another object of the invention is to provide method and apparatus for the production of a multifilament thermoplastic yarn which, when tufted or woven into a fabric, provides a grass-like appearance, relatively soft hand and exceptional cover characteristics.

Yet another object of the invention is to provide method and apparatus for the production of a grass-like multifilament thermoplastic yarn and a textile product using such yarn.

In accordance with the present invention it has been discovered that by extruding a melt-spinnable thermoplastic material in molten form through a spinneret die to form a plurality of filaments, quenching the thus-formed filaments of the yarn in a quenching liquid, drawing the thus quenched filaments of the yarn, heating at least a portion of the filaments of the thus drawn yarn, cooling the yarn, and heating the thus cooled yarn so as to thereby develop latent crimp in at least a portion of the filaments thereof, a grass-like yarn is produced which can provide a fabric product having exceptional cover characteristics, relatively soft hand and pleasing appearance. In another aspect, there is provided in the present invention novel apparatus for the formation of a grass-like multifilament thermoplastic yarn.

The present invention is illustrated in the accompanying drawings in which:

FIG. 1 is a diagrammatical representation of a system for forming a multifilament thermoplastic yarn of grass-like appearance;

FIG. 2 is an enlarged cross-section view of an underwater guide bar employed in the system illustrated in FIG. 1; and FIG. 3 is a cross-section view of a cut pile carpet tufted with the multifilament thermoplastic yarn of the present invention.

Referring now to the drawings, and to FIG. 1 in particular, a system for continuously forming multifilament thermoplastic yarn is illustrated therein. A melt-spinnable synthetic organic thermoplastic polymer, for example a polyamide, a polyester, a polyhydrocarbon such as a polyolefin, or a copolymer of one or more thereof, or other fiber-forming polymer, but preferably polypropylene, is converted to its molten form in an extruder 12 by a combination of external heat and generated heat caused by shear action, and is passed through separate passageways to two melt spin metering pumps driven by motors 14 and 16. The polymer can be blended with suitable pigments, stabilizers, antioxidants, delusterants, dye additives, antistatic materials, flame retardants or other suitable additives or mixtures of any two or more thereof. Molten polymer is passed at a metered rate from the metering pumps through screen packs to and through spinneret die plates 18 and 20 to form a plurality of filaments at each die plate. The temperature of the extruded melt can be any suitable value depending on the composition of the melt but will generally be in the range of about 204° C. to about 343° C., and, for polypropylene, the temperature will generally be in the range from about 232° C. to about 301° C. The extruder pressure can be any suitable value depending on the composition of the melt but will generally be in the range from about 1000 psi (6.89 MPa) to about 3000 psi (20.67 MPa).

The filaments from the spinneret die plates 18 and 20 pass through an air gap 22 into a body of quench liquid 24, such as water, maintained in a quench tank 26. The filaments from the die plates 18 and 20 pass around a stationary guide bar 28 extending across the quench tank. The guide bar is preferably provided with three rods 30 aligned parallel therewith and fixedly secured at the outer surface of the guide bar. The rods 30 can be made of any suitable hard-surface material such as a ceramic material or an aluminum oxide or titanium dioxide coated metal material. Metal rods can be suitably secured to the guide bar by means of tack welds at spaced intervals along the length thereof. The diameter of the guide bar can be of any suitable dimension but will generally be in the range from about ¾ inch (1.4 cm) to about 1¼ inch (3.2 cm) and preferably about 1 inch (2.5 cm). The rods 30 can be of any suitable diameter which will maintain the filaments passing thereover out of contact with the outer surface of the guide bar 28. A suitable diameter for the rods 30 is about 5/16 inch (0.8 cm). The rods 30 are preferably angularly spaced about the longitudinal axis of the guide bar 28 at about 90° from the adjacent rod nearest thereto, as best shown in FIG. 2.

The filaments from spinneret die plates 18 and 20 can be combined to form a filament bundle or yarn end, however, it is presently preferred to divide the filaments from the die plates 18 and 20 to form a plurality of filament bundles or yarn ends. In the process described herein it will be understood that the filaments are divided into 8 filament bundles or yarn ends which will be generally designated in the aggregate by the reference character 32. The filaments 32 are withdrawn from the quench tank 26 and passed via a comb-type yarn separating guide 34 through a tension ladder comprising stainless steel bars 36 and slotted pipes 38. The separating guide 34 serves to maintain separation among the eight filament bundles or yarn ends. The tension bars 36 create a constant tension source on the filaments for the feed or retarding rolls 40 to pull against, and further serve to remove some quench liquid from the surfaces of the filaments and align the filaments in a generally flat band to go through the feed rolls 40 evenly. The pipes 38, which are provided with transverse slots therein, are connected via line 42 to a vacuum pump 44 to provide means for removing excess quench liquid from the filaments. Additional slotted pipes 46 are disposed on opposite sides of the filaments 32 and are connected to an air pump 48 whereby each slotted pipe 46 directs a wall of air across the filaments. The wall of air is preferably directed at an angle in the range from about 10° to about 45° from a plane perpendicular to the filaments and opposite to the direction of movement of the filaments.

The first set or stand of feed or retarding rolls 40 are not externally heated and are positively driven at a uniform constant rate to pull the filaments out of the quench bath and through the tension ladder. The rolls 40 also serve as a restraining device for a second set or stand of positively driven draw rolls 50. The outer surface of each of the draw rolls 50 is heated by suitable means such as by steam or by electrical heaters. While the draw rolls 50 can be maintained at any temperature which will achieve the desired heating of the filaments passing thereover, the draw rolls 50 are generally maintained at a temperature in the range from about 210° F. (98.9° C.) to about 310° F. (154.4° C.), and preferably in the range from about 240° F. (115.6° C.) to about 280° F.) (137.8° C.). Heating the draw rolls 50 both facilitates the completion of the drawing of the filaments and heats at least a portion of the filaments to facilitate further conditioning in subsequent operations. A nip roll 52 rollingly engages the filaments as they pass over the last draw roll 50 in the second stand.

The heated draw rolls 50 act in concert with the relatively cold feed rolls 40 to draw the filaments of the plurality of yarn ends designated by the reference character 32. Although the filaments can be drawn to any suitable extent which will achieve the desired end result in the production of a grass-like yarn, the filaments are generally drawn to a draw ratio within the range from about 2.5 to about 3.6, preferably to a draw ratio in the range from about 2.9 to about 3.1 and more preferably to a draw ratio in the range from about 2.98 to about 3.02. A roll-type or other suitable type of finish applicator 54 can be installed between the slotted pipe 46 and the feed rolls 40. It will be understood, however, that the finish applicator can be installed elsewhere in the line as conditions may require.

The drawn and quenched filaments of the yarn ends or tows 32 are passed from the second stand of heated draw rolls 50 via a second comb-type yarn separating guide 56 to one or more yarn winders 58, preferably of the constant tension type, corresponding in number to the number of tows or ends of yarn being formed. Air cooling of the yarn ends takes place between the draw rolls 50 and the yarn winders 58. In a presently preferred embodiment, as noted above, 8 yarn ends are simultaneously processed in the system 10, thus permitting the simultaneous formation of 8 yarn packages 60 on 8 winders 58. While any suitable tension can be applied to each yarn end during winding onto a package 60, such winding is generally performed under relatively low tension force, preferably in the range from about 200 to about 350 grams of force.

The length of the air gap 22 extending from the faces of the spinnerets 18 and 20 to the upper surface of the body of quench liquid 24 has been found to be critical when processing a high population density of filaments from the spinnerets. In general, the gap 22 should be as small as possible while still being great enough to prevent quench liquid from splashing on the hot surfaces of the spinneret faces or localized boiling of the quench liquid, the gap being preferably less than about 1 inch (2.5 cm) and more preferably about ⅝ inch (1.6 cm) or less. In a presently preferred embodiment each of the die plates 18 and 20 is provided with 136 orifices each of generally rectangular cross section of suitable dimensions to provide a filament having a generally rectangular cross section with a width-to-thickness aspect ratio of approximately 6 to 1. In a presently preferred embodiment, each die plate provides filaments for 4 yarn ends or tows of 34 filaments each although other arrangements may be equally suitable.

The length of the air gap 22 can be controlled by utilizing an adjustable weir 62 to separate the main portion of the quench tank 26 from an overflow section 64. A drain line 66 is connected to the bottom of the overflow section 64. Instead of, or in addition to an adjustable weir or its equivalent, means can be provided to effect relative movement between the quench tank 26 and the spinneret die plates 18 and 20. A liquid level controller can be employed to maintain a desired level of quench liquid. If desired, the air gap 22 can be filled with an inert gas, for example, nitrogen, instead of air. Makeup quench liquid is passed through a conduit 68 into the quench tank 26. The temperature of the quench liquid in the tank 26 can be maintained substantially constant by a temperature recorder controller 70 manipulating a valve 72 interposed in the conduit 66 responsive to a comparison of the actual temperature of the quench liquid as indicated by a temperature sensor 74 and the desired quench temperature represented by a set point 76 on the controller 70. The quench tank 26 can be provided with baffles, if desired, to minimize circulating currents and vibrations. The makeup quench liquid can be tap water at the available temperature or water which has been cooled or heated as desired.

It has been found that the surface tension of the quench liquid becomes a significant factor with high filament population densities. With a filament population density of at least 25 spinning orifices per square inch of effective spinning area, it is desirable that the surface tension be maintained below 65 dynes per centimeter. With a filament population density of at least 40 spinning orifices per square inch of effective spinning area, it is desirable that the surface tension of the quench liquid be maintained below 55 dynes per centimeter. To provide greater assurance of preventing marriage of adjacent filaments, to provide a greater margin of safety and to reduce the system adjustment accuracy required, it has been found to generally be desirable to maintain the surface tension of the quench liquid below about 40 dynes per centimeter. A surface tension over 65 dynes per centimeter is sufficient at high filament population densities to cause lateral movement of the filaments in the air gap to the point where adjacent filaments adhere to each other. Such lateral movement also tends to introduce nonuniform stresses in the filaments. With a relatively short air gap, a high surface tension can result in sufficient deformation of the liquid surface to cause contact between the quench liquid and the spinneret face or sufficient proximity for the radiant heat from the spinneret face to induce localized boiling. While it is possible to reduce the surface tension of the quench liquid by raising the temperature thereof, operation at higher quench temperatures increases the risk of localized boiling by radiant heat from the spinneret face or by conduction from the filaments entering the quench liquid or both. Accordingly, when it is desired to reduce the surface tension of the quench liquid 24, the presently preferred practice is to introduce a surfactant into the quench liquid. The surfactant can be passed through a conduit 78 into the conduit 68 at which point the surfactant is admixed with the quench liquid. The rate of addition of the surfactant can be controlled by a ratio controller 80 manipulating a valve 82 interposed in the conduit 78 responsive to the flow rate of quench liquid through the conduit 68, as indicated by flow sensor 84, and the desired ratio of surfactant to quench liquid as represented by an input 86 to the ratio controller 80. A metering pump can be used instead of the valve 82. It has also been found that the use of a surfactant in the quench water aids in the removal of the water from the filament bundle or bundles as they pass through the tension ladder bars 36 and the slotted pipes 38 and 46.

The next step in the production of multifilament thermoplastic yarn in accordance with the present invention involves the feeding of yarn from a yarn package 60 through a conventional yarn twister and thence through a traverse guide and onto a takeup package. While any suitable twist can be applied to the yarn which will facilitate handling of the yarn in subsequent tufting, weaving, knitting, braiding, sewing or the like of the yarn into fabrics while maintaining the desired characteristics of appearance, cover and hand of the yarn in such fabrics, suitable twist in the yarn of the present invention is generally in the range from about 0.3 to about 2.0 twists per inch (t.p.i.), preferably from about 0.6 to about 1.5 t.p.i., and more preferably from about 0.9 to about 1.2 t.p.i. While any twister capable of handling the yarn of the present invention and applying the desired twist thereto can be employed in the instant process, it is presently preferred to utilize a conventional two-for-one twister. A suitable two-for-one twister for use in the process of the present invention is available from Verdol of Lyon, France and is designated as Model No. VDL 1515 22-G.

The twisted yarn on the takeup package is then ready for heating to thereby develop or manifest the latent crimp in the filaments thereof. Such heating of the yarn is preferably performed with the yarn is in a relaxed state. This can be accomplished in any suitable manner such as by feeding the yarn through an oven in a relaxed state or by feeding the yarn through boiling water in a relaxed state. The yarn can be subjected to any temperature which will achieve the manifestation of latent crimp in the filaments thereof, but generally the yarn is subjected in this heating step to a temperature in the range from about 200° F. (93.3° C.) to about 280° F. (137.8° C.). It may be desirable under certain circumstances, and it is certainly within the scope of the present invention, to subject the untwisted yarn from the package 60 to such a heating step either prior to the previously described twisting operation or prior to subsequent processing of the yarn without twisting.

A presently preferred technique for heating the twisted yarn of the present invention when such yarn is tufted or woven into cut pile carpet or the like is characterized by the application of heat in an oven to the tufted or woven carpet in order to cure the backing material, e.g. latex emulsion or foam polyvinyl chloride, which is positioned on the back side of the carpet which is in turn being fed through the oven. Such heating performs the dual functions of curing the backing material and developing or manifesting the latent crimp of the twisted fibers of the yarn of the present invention. Such a carpet construction is illustrated in FIG. 3 wherein a backing fabric 88 carries a plurality of cut yarn loops 90 and is further coated on the back side thereof with a suitable backing material 92 such as polyvinyl chloride, latex or the like.

It should further be noted that under certain circumstances it may also be desirable to subject either untwisted yarn from a package 60 or twisted yarn to a heating step in the temperature range from about 200° F. (93.3° C.) to about 280° F. (137.8° C.) with the yarn in a relaxed condition followed by winding the yarn with the latent crimp thus manifested therein onto a takeup package. It will also be understood that it is within the scope of the present invention to produce yarn continuously from extrusion from the extruder 12 of the system through the draw rolls 50, through twisting if desired, and through tufting, weaving, knitting, braiding, sewing or the like with heating of the yarn to manifest latent crimp either before or after such tufting, weaving, knitting, braiding, sewing or the like into fabrics.

Yarn produced in accordance with the present invention can be of any denier suitable for the intended use of the yarn, but generally such yarns will have a total denier in the range from about 1700 to about 6600, preferably from about 3200 to about 5800 and more preferably from about 3700 to about 4600. The denier per filament of the yarn can also be of any suitable value, but generally the denier per filament is in the range from about 50 to about 195, preferably from about 94 to about 171, and more preferably from about 108 to about 136.

EXAMPLE I

In operation, the system is run utilizing polypropylene as the melt-spinnable thermoplastic material. The first stand of feed rolls 40 are driven to provide a linear filament velocity of approximately 156 meters per minute. The second stand of draw rolls 50 are driven at a rate providing a linear filament velocity of approximately 467 meters per minute. The difference in linear velocity between the first and second stands of rolls provides a draw ratio of about 3.0. The roll surface temperature of the draw rolls 50 is maintained in the range from about 240° F. (115.6° C.) to about 280° F. (137.8° C.). The quench liquid (water) is maintained at a temperature of no more than about 41° C. The quench liquid-to-die distance or gap is about $\frac{3}{8}$ inch (0.9 cm). The winder tension is in the range from about 200 grams to about 250 grams. The process yields a 34 filament yarn of a denier in the range from about 3700 to about 3900 with a denier per filament in the range from about 108 to about 115.

EXAMPLE II

In this example the system is also run utilizing polypropylene as the melt-spinnable thermoplastic material. The first stand of feed rolls 40 are driven to provide a linear filament velocity of approximately 128 meters per minute. The second stand of draw rolls 50 are driven at a rate providing a linear filament velocity of approximately 383 meters per minute. The difference in linear velocity between the first and second stands of rolls provides a draw ratio of about 3.0. The draw rolls 50 are heated at their roll surfaces to a temperature in the range from about 240° F. (115.6° C.) to about 280° F. (137.8° C.). The quench liquid is maintained at a temperature of no more than about 41° C. The quench liquid-to-die distance or gap is maintained at about $\frac{5}{8}$ inch (1.6 cm). The tension applied to the yarn at the yarn winders is in the range from about 250 grams to about 350 grams. The process yields a 34 filament yarn having a denier in the range from about 4400 to about 4600 at a denier per filament in the range from about 129 to about 136.

EXAMPLE III

A yarn produced in accordance with Example II is twisted to about 1.05 t.p.i. to reduce friction and enhance tuftability. The thus twisted yarn is then tufted into a ready-made woven backing fabric. The inserted tufts are then cut to form a cut pile carpet. A coat of latex backing material is applied to the back side of the backng fabric and the thus assembled carpet is subjected to heating to a temperature in the range from about 200° F. (93.3° C.) to about 280° F. (137.8° C.) to thereby cure the latex backing material and manifest the latent crimp in the filaments of the tufted yarn. This crimp development enhances the covering power of the tufted yarn without the carpet backing fabric showing through.

It will be understood that the development of latent crimp in cut pile carpet employing the grass-like yarn of the present invention makes it possible to use less yarn without the carpet backing showing through, and it also makes possible more styling varieties, such as high-low carpet, in which ordinary grass-like yarns are not suitable due to poor cover in the low portions of the carpet pile.

Reasonable variations and modifications which will be apparent to those skilled in the art can be made in this invention without departing from the spirit and scope thereof.

That which is claimed is:

1. A method of forming yarn comprising the steps of:

(a) extruding a melt-spinnable plastic material in molten form through spinning orifices of at least one spinneret die to form a yarn end comprising a plurality of filaments;

(b) quenching and cooling said thus formed filaments of said yarn end in a quenching liquid;

(c) drawing the thus quenched and cooled filaments of said yarn end so as to form a drawn yarn end;

(d) passing the thus drawn yarn end over a heated surface so as to heat at least a portion of said filaments;

(e) cooling the yarn end thus passed over said heated surface; and (f) thereafter heating the thus cooled yarn end so as to thereby develop latent crimp in at least a portion of the filaments thereof.

2. A method in accordance with claim 1 wherein said thus cooled yarn end is twisted prior to the heating step (f).

3. A method in accordance with claim 1 or claim 2 wherein the quenched and drawn filaments are passed over a heated surface having a temperature in the range from about 210° F. (98.9° C.) to about 310° F. (154.4° C.).

4. A method in accordance with claim 1 or claim 2 wherein the quenching liquid comprises water.

5. A method in accordance with claim 1 or claim 2 wherein said heated surface has a temperature in the range from about 240° F. (115.6° C.) to about 280° F. (137.8° C.).

6. A method in accordance with claim 1 or claim 2 wherein the thus cooled yarn end is formed into a yarn package under a predetermined tension force and the yarn end is subsequently fed from the yarn package and heated at step (f).

7. A method in accordance with claim 6 wherein said predetermined tension force is in the range from about 200 grams of force to about 350 grams of force.

8. A method in accordance with claim 2 wherein a twist is applied to the yarn end in the twisting step in the range from about 0.6 to about 1.5 twists per inch.

9. A method in accordance with claim 8 wherein said twist is from about 0.9 to about 1.2 twists per inch.

10. A method in accordance with claim 1 or claim 2 wherein said melt-spinnable plastic material comprises at least one polyolefin.

11. A method in accordance with claim 10 wherein said at least one polyolefin is polypropylene.

12. A method in accordance with claim 1 or claim 2 wherein said melt-spinnable plastic material is polypropylene.

13. A method in accordance with claim 1 or claim 2 wherein the spinning orifices are each generally rectangular in shape.

14. A method in accordance with claim 13 wherein each generally rectangular orifice is shaped so as to extrude melt-spinnable plastic material therethrough of a generally rectangular cross section having a width-to-thickness aspect ratio of approximately 6 to 1.

15. A method in accordance with claim 1 or claim 2 wherein said yarn is subjected to a temperature in the range from about 200° F. (93.3° C.) to about 280° F. (137.8° C.) in the heating step (f).

16. A method in accordance with claim 1 or claim 2 wherein said yarn is heated in step (f) by contacting said yarn in a relaxed state with boiling water.

17. A method in accordance with claim 1 or claim 2 wherein said yarn is heated in step (f) in a relaxed state in an oven.

18. A method in accordance with claim 15 wherein said yarn is heated in step (f) in a relaxed state in an oven.

19. A method of forming a textile product comprising the steps of:

(a) extruding a melt-spinnable plastic material in molten form through a plurality of spinning orifices of at least one spinneret die so as to form a yarn end comprising a plurality of filaments;

(b) quenching said thus extruded filaments of said yarn end in a quenching liquid;

(c) withdrawing said thus quenched filaments of said yarn end from said quenching liquid at a first linear speed by means of unheated feed rolls engaging said yarn end;

(d) withdrawing said filaments of said yarn end from said unheated feed rolls at a second linear speed greater than said first linear speed by means of heated draw rolls engaging said yarn end;

(e) heating at least a portion of the filaments of said yarn end by means of contact with said heated draw rolls; and (f) winding said thus heated yarn end under a predetermined tension to form a yarn package.

20. A method in accordance with claim 19 characterized further to include the steps of:

(g) feeding the yarn end from said yarn package; and (h) twisting the thus fed yarn end so as to form a twisted yarn.

21. A method of forming a textile product comprising the steps of:

(a) extruding a melt-spinnable plastic material in molten form through a plurality of spinning orifices of at least one spinneret die so as to form a yarn end comprising a plurality of filaments;

(b) quenching said thus extruded filaments of said yarn end in a quenching liquid;

(c) withdrawing said thus quenched filaments of said yarn end from said quenching liquid at a first linear speed by means of unheated feed rolls engaging said yarn end;

(d) withdrawing said filaments of said yarn end from said unheated feed rolls at a second linear speed greater than said first linear speed by means of heated draw rolls engaging said yarn end;

(e) heating at least a portion of the filaments of said yarn end by means of contact with said heated draw rolls; and (f) twisting the yarn end so as to form a twisted yarn.

22. A method in accordance with claim 20 or claim 21 characterized further to include the additional step of heating the thus twisted yarn to thereby induce the manifestation of latent crimp in the filaments thereof.

23. A method in accordance with claim 20 or claim 21 wherein the thus twisted yarn is tufted into carpet backing fabric to form a carpet and the thus formed carpet is heated to thereby induce the manifestation of latent crimp in the filaments of the tufted, twisted yarn whereby at least a portion of said filaments shrink and curl, thus increasing the covering power of the yarn in the carpet.

24. A method in accordance with claim 23 wherein said carpet is heated during application of backing material to said carpet backing fabric.

25. A method in accordance with claim 19 characterized further to include the steps of:

feeding the yarn end from said yarn package; and heating the thus fed yarn end to thereby induce the manifestation of latent crimp in the filaments thereof.

26. A method in accordance with claim 19 characterized further to include the steps of:

feeding the yarn end from said yarn package;

tufting the thus fed yarn end into carpet backing fabric to form a carpet; and heating the thus formed carpet to thereby induce the manifestation of latent crimp in the filaments of the tufted yarn whereby at least a portion of said filaments shrink and curl, thus increasing the covering power of the yarn in the carpet.

27. A method in accordance with claim 26 wherein said carpet is heated during application of backing material to said carpet backing fabric.

* * * * *